US007395941B2

(12) United States Patent
Hong

(10) Patent No.: US 7,395,941 B2
(45) Date of Patent: Jul. 8, 2008

(54) ARTIFICIAL NIPPLE WITH REINFORCEMENT

(76) Inventor: Suk-Chu Hong, 529, Sangdong, Joengeup-si, Joenbuk (KR)

( * ) Notice: Subject to any disclaimer, the term of this patent is extended or adjusted under 35 U.S.C. 154(b) by 401 days.

(21) Appl. No.: 10/522,378

(22) PCT Filed: Oct. 31, 2002

(86) PCT No.: PCT/KR02/02032

§ 371 (c)(1),
(2), (4) Date: Jan. 26, 2005

(87) PCT Pub. No.: WO2004/010921

PCT Pub. Date: Feb. 5, 2004

(65) Prior Publication Data

US 2006/0060551 A1 Mar. 23, 2006

(30) Foreign Application Priority Data

Jul. 26, 2002 (KR) ..... 10-2002-0044118

(51) Int. Cl.
*A61J 11/02* (2006.01)

(52) U.S. Cl. ..... 215/11.1; 215/11.5

(58) Field of Classification Search ..... 215/11.1, 215/11.5; 606/234, 236
See application file for complete search history.

(56) References Cited

U.S. PATENT DOCUMENTS 2,105,170 A * 1/1938 Tarrant ..... 215/11.1
2,582,950 A * 1/1952 Alstadt et al. ..... 215/11.5
2,672,870 A * 3/1954 Alstadt et al. ..... 215/11.5
2,794,436 A * 6/1957 Kurkjian ..... 215/11.1
3,718,140 A * 2/1973 Yamauchi ..... 215/11.1
4,505,398 A * 3/1985 Kesselring ..... 215/11.5
5,673,806 A * 10/1997 Busnel ..... 215/11.1

FOREIGN PATENT DOCUMENTS

DE 41339064 A1 * 4/1993
EP 0457697 A1 * 11/1991

(Continued)

*Primary Examiner*—Sue A Weaver
(74) *Attorney, Agent, or Firm*—Stites & Harbison PLLC; Douglas E. Jackson

(57) ABSTRACT

The present invention relates to an artificial nipple. More particularly, the present invention relates to an artificial nipple, which has durability enough not to be torn with fatigue load resulting from teeth contact since fiber nets are embedded within the thickness of the artificial nipple, eliminates a difficulty in breathing by facilitating the flow of air, and prevents obstruction of the airway of an infant by distributing milk suction pressure when the infant sucks milk. The artificial nipple according to the present invention has a nipple body including a root portion, a teat portion with a feeding hole, and a narrow neck portion for making a connection between the root portion and the teat portion. The artificial nipple further comprises fiber nets (20) in the form of bands which are embedded within the thickness of the nipple body (10) such that they extend in a lengthwise direction L of the nipple body and are spaced apart form one another at a predetermined interval in a circumferential direction A of the nipple body, and an air inflow groove (15) formed in a portion of a surface of the nipple body (10) which does not overlap with the fiber nets such that the air flow groove is connected to the feeding hole (12).

3 Claims, 4 Drawing Sheets

FOREIGN PATENT DOCUMENTS

| | | | | |
|---|---|---|---|---|
| EP | 0555165 | A1 | * | 8/1993 |
| FR | 2657252 | A1 | * | 7/1991 |
| JP | 5-84279 | | | 4/1993 |
| JP | 1939 | | | 1/1995 |
| JP | 10185048 | | * | 7/1998 |
| KR | 86-5632 | | | 8/1986 |
| KR | 89-2232 | | | 3/1989 |
| KR | 89-2233 | | | 3/1989 |

* cited by examiner

ARTIFICIAL NIPPLE WITH REINFORCEMENT

TECHNICAL FIELD

The present invention relates to an artificial nipple.

More particularly, the present invention relates to an artificial nipple, which has durability enough not to be torn with fatigue load resulting from teeth contact since fibers net are embedded within the thickness of the artificial nipple, eliminates a difficulty in breathing by facilitating the flow of air, and prevents obstruction of the airway of an infant by distributing milk suction pressure when the infant sucks milk.

BACKGROUND ART

Artificial nipples are classified into thump type nipples and roman or round type nipples. In such artificial nipples (hereinafter, simply refer to as "nipples"), there is no change in the positions of feeding holes that are located at the centers of the nipples while there is a difference only in the sizes of the feeding holes according to infants' ages.

In case of a thumb type nipple, since a feeding hole 2 is merely located at a position offset slightly upward from the center of the nipple as shown in FIG. 1, the feeding hole 2 is considered as being substantially directed to the palate of an infant when the infant normally holds a teat portion 1 of the nipple in the mouth.

Since the feeding hole is not oriented directly toward the throat of the infant in view of the position of the feeding hole 2, this configuration may be understood as being a safe configuration for avoiding the throat. However, it should be noted that it is not true due to the following reasons.

That is, although the feeding hole 2 in case of the thumb type nipple is located approximately in the middle of the palate of the infant, this position can never be considered as a safe position in unspecified postures such as a lying posture except normal postures such as a sitting or standing posture of the infant when the infant sucks milk. When the infant lies on his/her back, it can be considered that his/her airway is opened. Even though the feeding hole 2 is oriented toward the palate of the infant, it is substantially impossible for the infant himself/herself to delay or block a linear flow of milk introduced from the palate into the throat of the infant in view of low reflexes of the infant. Therefore, a configuration in which the feeding hole 2 is in line with the throat as in the thumb type nipple can be considered as having low safety.

In case of a roman type nipple, the aforementioned problem becomes much severer. In this type nipple, a feeding hole 2 is formed at the vertex of a sphere-type teat portion 1 as shown in FIG. 2 and thus a direction in which milk is discharged from the feeding hole 2 is in line with the direction of the throat of the infant. Accordingly, since the milk is introduced directly into the throat when the infant sucks the milk, there is a very high possibility that a risk of respiratory disturbance may occur.

In cases of both the thumb and roman type nipples, air is not commonly introduced into the mouth of the infant. Thus, a high vacuum pressure is established in the mouth when the infant sucks the milk, and a high milk suction pressure is generated. This leads introduction of the sucked milk into ears, eyes or lungs of the infant, which may be a cause of various diseases and death. Therefore, there is a need for a countermeasure against such a problem.

Further, in such a conventional nipple, there is a high possibility that an indented neck portion 3 of the nipple with which teeth of the infant intensively come into contact may be damaged, as compared with the other portions of the nipple.

Thus, there is the risk of safety accident due to tear of the nipple.

In this regards, the present applicant has proposed a silicon nipple with a fiber net embedded therein in Korean Utility Model Registration No. 137262. With the embedded fiber net 4 in the nipple as shown in FIG. 3, even though a portion of the nipple is torn, the torn silicon portion of the nipple is prevented from falling off.

Although the nipple with the fiber net embedded therein can be easily manufactured since the fiber net 4 is embedded throughout the nipple, however, a great deal of the fiber net is required, which leads in economic inefficiency and increase of the unit cost of the nipple.

DISCLOSURE OF INVENTION

Therefore, the present invention is conceived to solve the aforementioned problems in the related art. An object of the present invention is to provide an artificial milk-feeding nipple, wherein fiber nets are embedded to a minimum in an efficient manner to reduce production costs of the nipple.

Another object of the present invention is to provide an artificial milk-feeding nipple, wherein outside air is sucked together upon feeding milk so that milk can be continuously sucked without separate regulation of breathing, and a milk suction pressure is distributed to reduce the risk of obstruction of the airway due to concentrated discharge of the milk.

According to the present invention for achieving the objects, there is provided an artificial nipple having a nipple body including a root portion, a teat portion with a feeding hole, and a narrow neck portion for making a connection between the root portion and the teat portion, comprising fiber nets in the form of bands which are embedded within the thickness of the nipple body such that they extend in a lengthwise direction of the nipple body and are spaced apart from one another at a predetermined interval in a circumferential direction of the nipple body, and an air inflow groove formed in a portion of a surface of the nipple body which does not overlap with the fiber nets such that the air flow groove is connected to the feeding hole.

Further, a reinforcement thickening may be formed around the feeding hole in an inner surface of the nipple body.

Moreover, as the nipple body is viewed in a circular cross section thereof, an apex or summit of a valley of the air inflow groove may be offset toward one side by θ from the centerline of the nipple body.

Furthermore, a reinforcement thickening may be formed at a portion of an inner surface of the nipple body that is at the back of the air inflow groove.

BEST MODE FOR CARRYING OUT THE INVENTION

Figure 1:
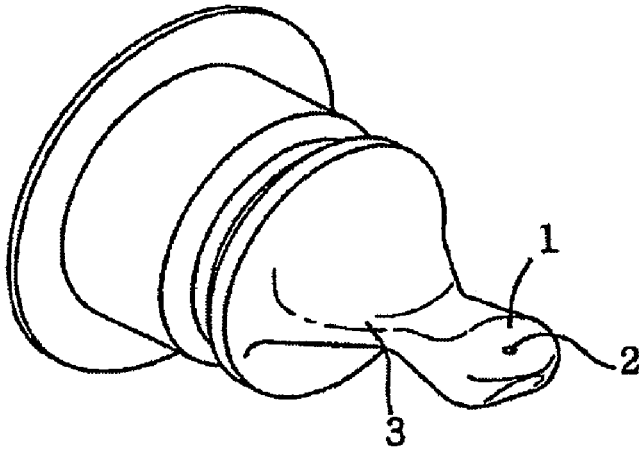
FIG. 1 PRIOR ART
FIG. 1 is a perspective view showing the configuration of a conventional thumb type of artificial nipple.
Figure 2:
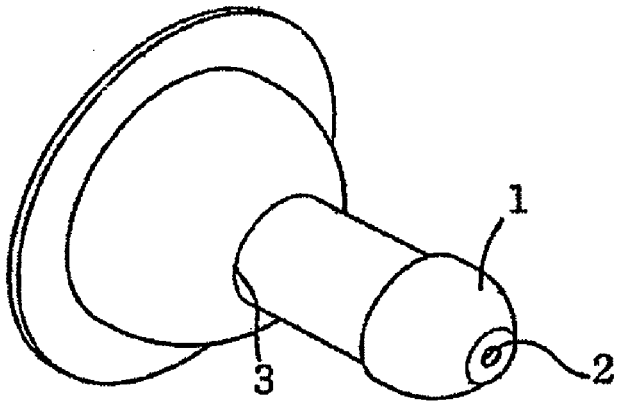
FIG. 2 PRIOR ART
FIG. 2 is a perspective view showing the configuration of a conventional roman type of artificial nipple.
Figure 3:
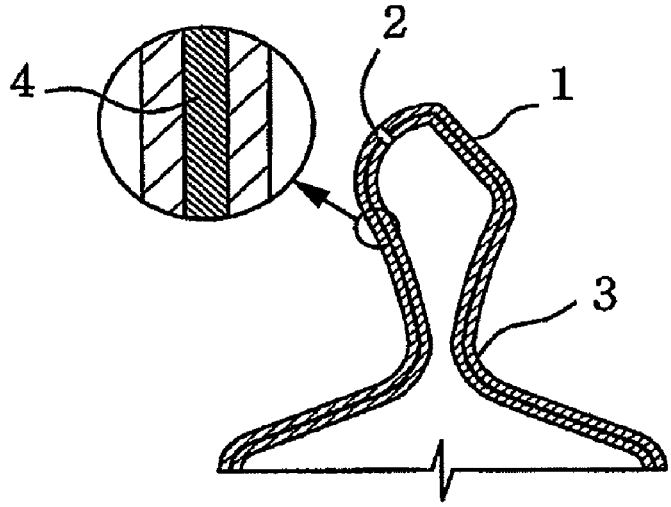
FIG. 3 PRIOR ART
FIG. 3 is a longitudinal sectional view of a conventional artificial nipple with a fiber net embedded therein.

Hereinafter, a preferred embodiment of the present invention will be described in detail with reference to the accompanying drawings.

An artificial nipple according to the present invention comprises a nipple body 10 including a root portion 11, a teat portion 13 with a feeding hole 12, and a narrow neck portion 14 for making a connection between the root portion 11 and the teat portion 13.

Fiber nets 20 are embedded in the form of stripes within the thickness t of the nipple body 10. That is, the fiber nets 20 take the shape of bands and are embedded such that they extend in a lengthwise direction L of the nipple body 10 and are spaced apart from one another at a predetermined interval in a circumferential direction A of the nipple body 10.

This case is efficient since the basic function of delaying or preventing complete breakage of the neck portion 14 is maintained even while the amount of the embedded fiber nets 20 can be greatly decreased as compared with that of the conventional nipple described above.

A variety of methods of embedding the fiber nets 20 can be applied.

Figure 7:
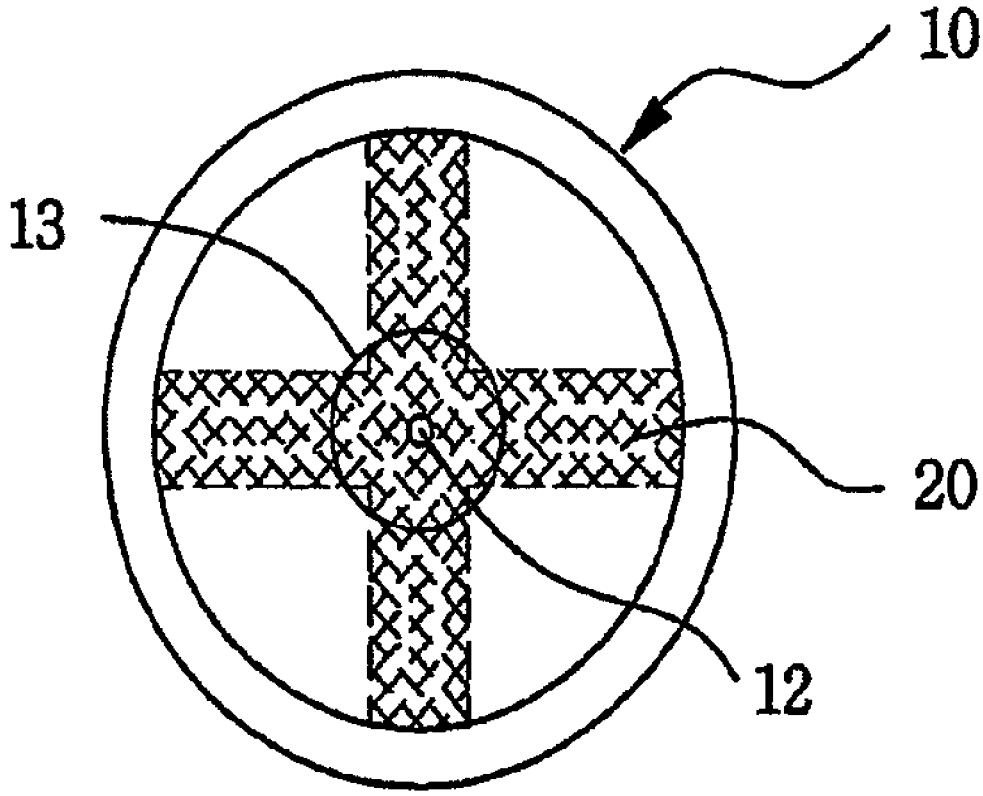
FIG. 7 is a view of the nipple as viewed in a direction designated by "B" in FIG. 4.

For example, as shown in FIG. 7, one fiber net in the form of a band is disposed from one side of the root portion to the opposite side of the root portion via the vertex of the teat portion 13, and another fiber net in the form of a band is repeatedly disposed at a position where it does not overlap with the previous fiber net in the same manner as the previous fiber net. Thus, a fiber net arrangement in the form of stripes is obtained. In this case, the respective fiber nets overlap with each other at the vertex of the teat portion 13.

Figure 4:
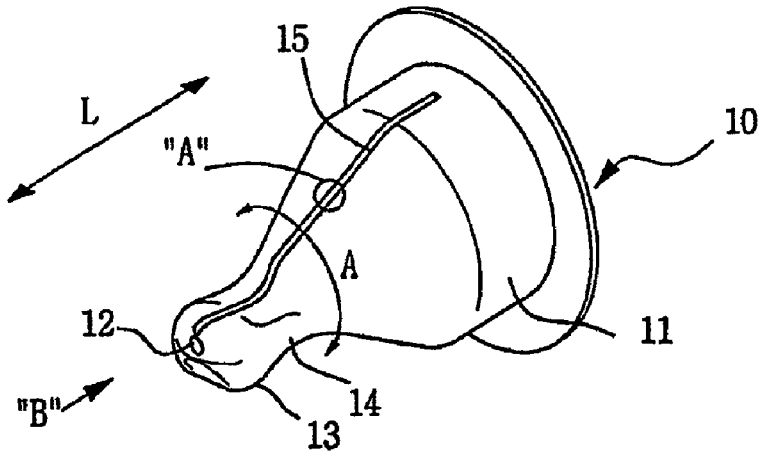
FIG. 4 is a view showing the configuration of an artificial nipple according to the present invention.
Figure 5:
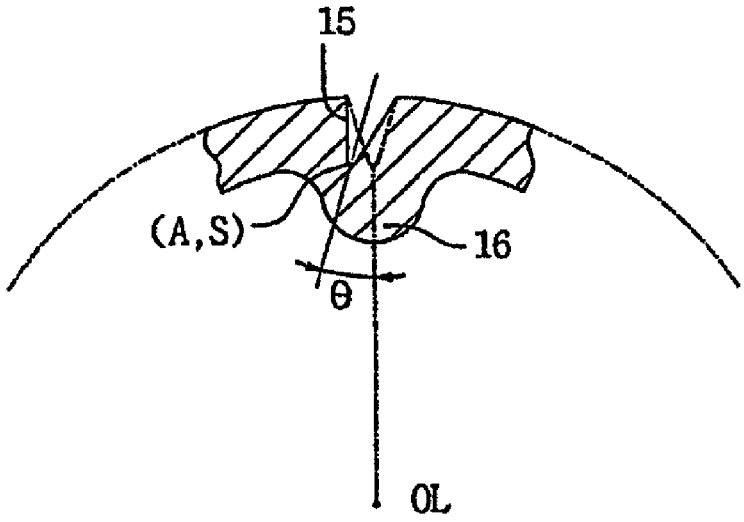
FIG. 5 is a sectional view of a portion of the nipple designated by "A" in FIG. 4.

In the nipple of the present invention, an air inflow groove 15 for connecting the root portion 11 and the feeding hole 12 is formed in a portion of a surface of the nipple body 10 that does not overlap with any fiber nets 20, as shown in FIGS. 4 and 5, so that outside air can be introduced through the air inflow groove 15 upon feeding milk.

Of course, a conventional nipple has also been formed with an air hole that performs a function similar to the outside air-introducing function. However, the air inflow groove in the present invention is distinguishable from the air hole as follows. The primary object of the air hole is to cause outside air to be introduced into the nipple upon feeding milk so that the inner pressure of the nipple can become the atmospheric pressure, thereby ensuring smoothness of milk suction. On the contrary, the air inflow groove 15 in the present invention is cause outside air to be introduced into the mouth of an infant so that the pressure in the mouth can become the atmospheric pressure, thereby ensuring the smoothness of milk suction.

Since the air inflow groove 15 is connected to the feeding hole 12, air guided by the air inflow groove 15 disperses milk discharged from the feeding hole 12 to prevent the milk from being injected in a certain direction.

Further, since the pressure in the mouth is the atmospheric pressure upon feeding the milk, the milk suction pressure is not high and thus high-pressure injection of the milk is prevented.

Therefore, it is possible to obtain an excellent effect of preventing obstruction of the airway or occurrence of a sneeze-like spasm of infant's windpipe due to the concentrated discharge or high-pressure injection of milk.

The air inflow groove 15 in the present invention is substantially U- or V-shaped in section as shown in FIG. 5 in such a manner that as the nipple body 10 is viewed in a circular cross section thereof, an apex A or summit S of a valley of the air inflow groove 15 is offset by θ from the centerline OL of the nipple body 10.

The feature of such a design of the air inflow groove 15 is to maintain the configuration of the air inflow groove 15 even though the nipple body 10 is deformed upon feeding milk, thereby ensuring smoothness of air inflow.

More specifically, it will be apparent that since the nipple is made of freely deformable and flexible silicon material, it is deformed due to the milk suction pressure upon feeding milk. If the air inflow groove 15 becomes flat and thus its configuration disappears due to such deformation, the air inflow groove may not properly perform its function.

Accordingly, when the inclined angle is applied to the air inflow groove 15 as described above, resistance against the deformation by which the air inflow groove becomes flat is increased. Thus, since a capability for maintaining the configuration of the air inflow groove is enhanced, the air inflow function can be maintained regardless of whether the nipple body 10 is deformed, thereby ensuring reliability.

Considering that the nipple body 10 in the present invention becomes thin at a portion corresponding to the air inlet groove due to the formation of the air inflow groove 15, a reinforcement thickening 16 is formed at a portion of an inner surface of the nipple body 10 that is at the back of the air inflow groove 15, as shown in FIG. 5.

Figure 6:
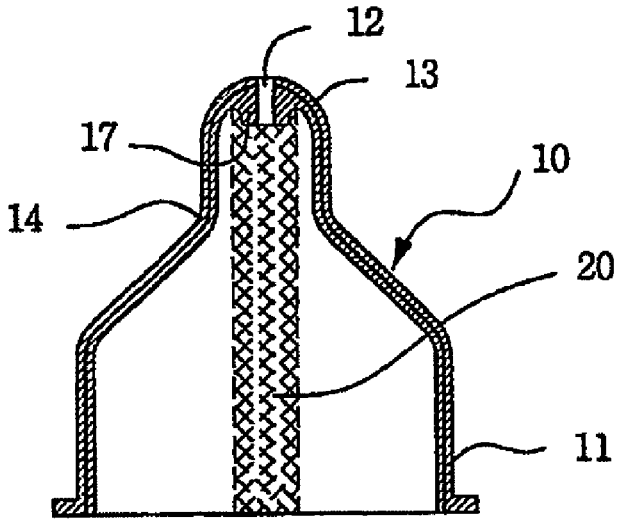
FIG. 6 is a longitudinal sectional view of the artificial nipple according to the present invention.

Further, a reinforcement thickening 17 is also formed around the feeding hole 12 in the inner surface of the nipple body 10, as shown in FIG. 6, so as to prevent premature breakage of the nipple due to stress concentration around the feeding hole 12.

As described above, since the fiber nets are embedded locally in the nipple in the present invention, the breakage life of the neck portion is prolonged even while materials can be utilized efficiently. Even though the neck portion is torn, it is prevented from easily falling off. Thus, it is possible to ensure safety and reliability.

Moreover, there are advantages in that smooth milk suction can be achieved due to suction of outside air together with milk and the obstruction of the airway or occurrence of a sneeze-like spasm of the windpipe can be avoided in advance due to the distribution of the milk suction pressure.

REFERENCE NUMERALS FOR DESIGNATING MAIN COMPONENTS IN THE DRAWING

10: Nipple body
11: Root portion
12: Feeding hole
13: Teat portion
14: Neck portion
15: Air inflow groove
16, 17: Reinforcement thickening
20: Fiber net

The invention claimed is:

1. An artificial nipple having a nipple body including a root portion, a teat portion with a feeding hole, and a narrow neck portion for making a connection between the root portion and the teat portion, comprising:

fiber nets in the form of bands which are embedded within the thickness of the nipple body such that they extend in a lengthwise direction of the nipple body and are spaced apart from one another at a predetermined interval in a circumferential direction of the nipple body; and an air inflow groove formed in a portion of a surface of the nipple body which does not overlap with the fiber nets such that the air flow groove is connected to the feeding hole, wherein an apex or summit of a valley of the air inflow groove is offset toward one side from the centerline of the nipple body.

2. The nipple as claimed in claim 1, further comprising a reinforcement thickening formed around the feeding hole in an inner surface of the nipple body.

3. The nipple as claimed in claim 1, further comprising a reinforcement thickening formed at a portion of an inner surface of the nipple body that is at the back of the air inflow groove.

* * * * *